US005945983A

United States Patent [19]

Kanno et al.

[11] Patent Number: 5,945,983

[45] **Date of Patent: *Aug. 31, 1999**

[54] DISPLAY CONTROL APPARATUS USING PLL

[75] Inventors: Hideo Kanno; Takashi Tsunoda, both of Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/555,174

[22] Filed: Nov. 8, 1995

[30] Foreign Application Priority Data

Nov. 10, 1994 [JP] Japan ..... 6-276546

[51] Int. Cl.[6] ..... G09G 5/18

[52] U.S. Cl. ..... 345/204; 348/537; 348/540

[58] Field of Search ..... 348/536, 537, 348/538, 540, 500, 516, 572; 345/204, 213, 132

[56] References Cited

U.S. PATENT DOCUMENTS

| | | | |
|---|---|---|---|
| 4,203,076 | 5/1980 | Yamashita | 348/537 |
| 4,698,601 | 10/1987 | Aizawa | 348/537 |
| 4,701,795 | 10/1987 | Andrews et al. | 348/571 |
| 4,748,510 | 5/1988 | Umezawa | 358/236 |
| 4,780,759 | 10/1988 | Matsushima | 348/537 |
| 4,795,239 | 1/1989 | Yamashita et al. | 345/87 |
| 4,962,376 | 10/1990 | Inoue et al. | 345/97 |
| 5,019,907 | 5/1991 | Murakoshi et al. | 358/158 |
| 5,068,731 | 11/1991 | Takeuchi | 348/581 |
| 5,233,446 | 8/1993 | Inoue et al. | 345/87 |
| 5,426,468 | 6/1995 | Jenison | 348/514 |

FOREIGN PATENT DOCUMENTS

| | | |
|---|---|---|
| 0 622 775 | 11/1994 | European Pat. Off. . |
| 2165128 | 4/1986 | United Kingdom . |

*Primary Examiner*—Lun-Yi Lao

*Attorney, Agent, or Firm*—Fitzpatrick, Cella, Harper & Scinto

[57] ABSTRACT

A display control apparatus for forming dot clocks for display corresponding to a video signal from a first sync signal and executing a display control is constructed by a comparator for comparing the first sync signal and frequency division signals, a clock forming circuit for forming the dot clocks for display on the basis of a result of the comparator, a memory in which frequency division parameters of the dot clocks for display have been stored, a frequency division signal forming circuit for forming the frequency division signals from the frequency division parameters and the dot clocks for display, a counter for counting the first sync signal, and a changing circuit for changing the frequency division parameters stored in the memory in the case where a count value of the counter reaches a predetermined value.

21 Claims, 4 Drawing Sheets

DISPLAY CONTROL APPARATUS USING PLL

BACKGROUND OF THE INVENTION

1. Field of the Invention

The invention relates to a display control apparatus and, more particularly, to a display control apparatus for forming a frequency that is integer times as high as a frequency of a certain reference signal and performing a display control.

2. Related Background Art

Hitherto, to form a frequency that is integer times as high as a frequency of a certain reference signal from such a reference frequency, a PLL (Phase Locked Loop) as an AFC (Automatic Frequency Control) loop for tracing the frequency of the reference signal and an APC (Automatic Phase Control) loop for tracing the phase of the reference signal is used. Generally, the PLL is constructed by a phase difference detector, a low pass filter (LPF), and a voltage controlled oscillator (VCO). The PLL used here further has a frequency divider.

Ordinarily, a VCO output signal is frequency divided by a predetermined frequency division parameter, a phase of the frequency division result and a phase of the reference signal are compared, and a fluctuation of the reference signal is traced, thereby forming a stable integer-times frequency that is phase locked with the reference signal.

By using such a PLL function, a horizontal sync signal is set to a reference signal to the PLL, thereby reproducing dot clocks of an input video signal source.

When different frequencies exist in a portion or a plurality of portions in the horizontal sync signal, however, since there is one (constant) frequency division parameter, it is impossible to trace the horizontal sync signal and there is a drawback such that the dot clocks are reproduced at an unstable frequency and an unstable phase lock (large jitter).

It is an object of the invention to provide a display control apparatus for reproducing stable dot clocks by phase locking a PLL even when a plurality of frequencies exist in a reference signal.

SUMMARY OF THE INVENTION

According to the invention, there is provided a display control apparatus for forming dot clocks for display corresponding to a video signal from a first sync signal and performing a display control, comprising: comparing means for comparing the first sync signal and frequency division signals; clock forming means for forming dot clocks for display on the basis of a result of the comparing means; storing means in which frequency division parameters of the dot clocks for display have been stored; frequency division signal forming means for forming the frequency division signals from the frequency division parameters and the dot clocks for display; counting means for counting the first sync signal; and changing means for changing the frequency division parameters stored in the storing means in the case where a count value of the counting means reaches a predetermined value.

According to the invention, there is provided a display control apparatus for forming dot clocks for display corresponding to a video signal from a first sync signal and performing a display control, comprising: comparing means for comparing the first sync signal and frequency division signals; clock forming means for forming dot clocks for display on the basis of a result of the comparing means; storing means in which frequency division parameters of the dot clocks for display have been stored; frequency division signal forming means for forming the frequency division signals from the frequency division parameters and the dot clocks for display; detecting means for detecting a change of the first sync signal; and changing means for changing the frequency division parameters stored in the storing means in the case where the change of the first sync signal is detected by the detecting means, wherein the detecting means is constructed by a line counter for counting the change of the first sync signal on the basis of a second sync signal and a register having a plurality of predetermined values, and the detecting means detects the change of the first sync signal by checking whether the count value of the counter has reached the predetermined value or not.

According to the invention, there is provided a display control apparatus comprising: comparing means for comparing a first sync signal and frequency division signals; clock forming means for forming dot clocks for display on the basis of a result of the comparing means; storing means in which frequency division parameters of the dot clocks for display have been stored; frequency division signal forming means for forming the frequency division signals from the frequency division parameters and the dot clocks for display; counting means for counting the first sync signal; changing means for changing the frequency division parameters stored in the storing means in the case where a count value of the counting means reaches a predetermined value; a converter for analog-digital converting an image signal which is supplied from an outside on the basis of the dot clocks and forming display data; data storing means for storing the display data converted by the converter; and a display for displaying the display data stored in the data storing means.

DETAILED DESCRIPTION OF THE PREFERRED EMBODIMENT

An embodiment of the present invention will now be described with reference to the drawings.

Figure 1:
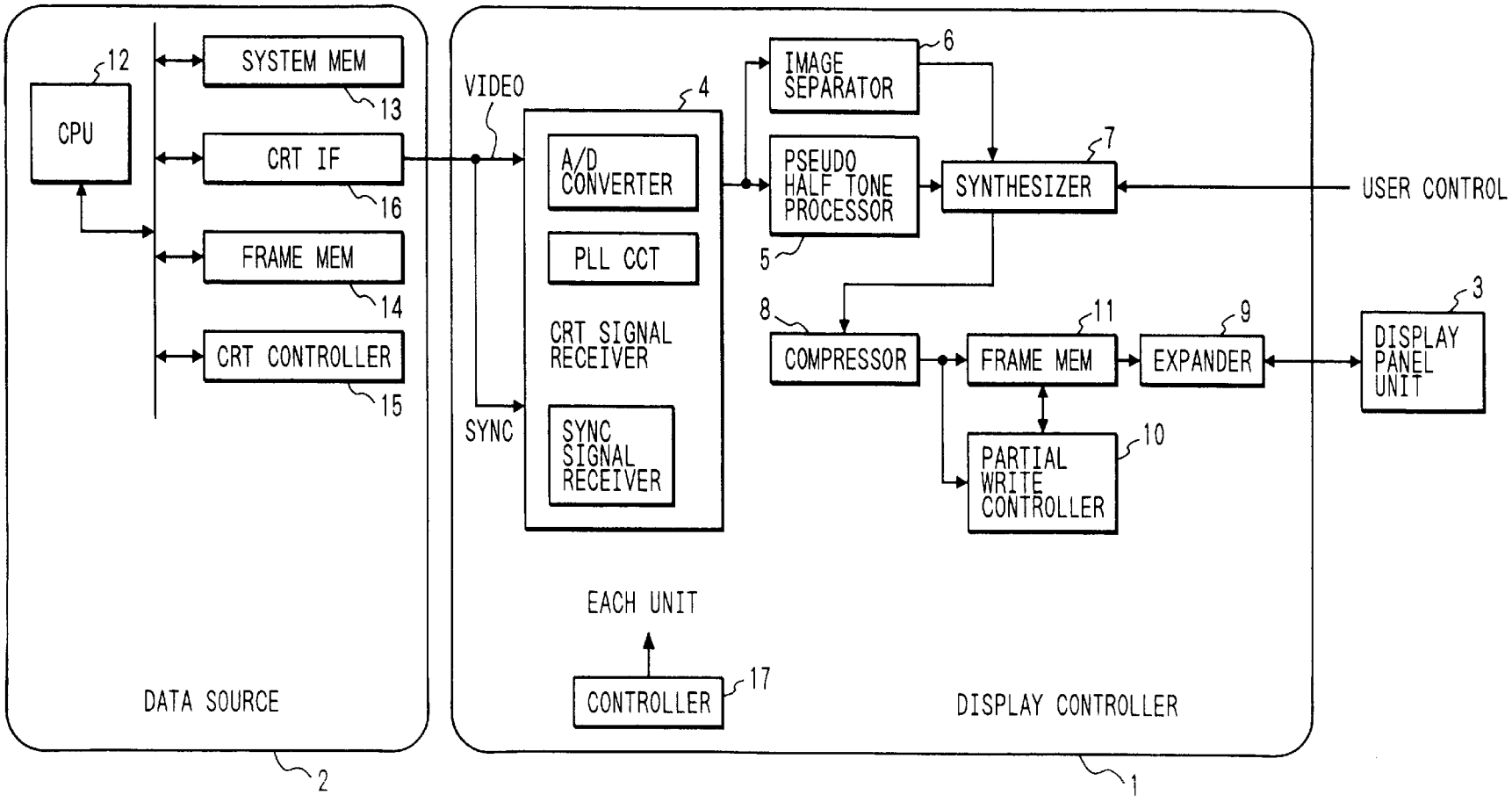
FIG. 1 is a block diagram of an embodiment of a data processing system having a display control apparatus according to the invention.

FIG. 1 is a block diagram of an embodiment of a data processing system having a display control apparatus according to the invention.

In the diagram, reference numeral 1 denotes a display controller according to the invention; 2 a computer comprising, for example, a personal computer, a workstation, or the like serving as a data source of the display controller 1; and 3 a display panel unit for displaying image data. The display panel unit 3 has therein a driving circuit for driving a display panel, a control circuit for driving the display panel in an optimum driving state, a backlight for the panel, a power source, and the like. Reference numeral 4 denotes a CRT signal receiver for receiving a CRT signal (image signal, sync signal) which is outputted from the computer 2 and converting into a signal suitable for each processor at the next stage.

Since the CRT signal of a general computer is an analog video signal, the inside of the CRT signal receiver 4 comprises an A/D converter, a PLL circuit unit to generate a sampling clock for A/D conversion, and a sync signal receiver. Reference numeral 5 denotes a pseudo halftone processor for performing a two-value or multi-value pseudo halftone process to the image data converted to the digital signal in the CRT signal receiver 4. As a processing method of the two-value or multi-value pseudo halftone, any one of the following methods is used.

Error Diffusing Method

Method whereby a weight is added to a two-value or multi-value errors which occur when peripheral pixels of a target pixel (pixels before the target pixel is processed) are converted to two values or multi-values and, thereafter, the resultant values are added to the target pixel, thereby performing a binarizing process on the basis of a predetermined threshold value.

Average Density Preserving Method

In the above error diffusing method, the binarization threshold value is not set to be constant but a threshold value is determined by a weight average value which is derived from the data that has already been binarized near the target pixel, and the threshold value can be varied in accordance with the state of the pixel.

By at least one of those methods, the pseudo halftone process can be executed.

It is also possible to have functions for executing the above plurality of methods and to switch them by the selection of the user.

Reference numeral 6 denotes an image separator (including a simple binarizing process) for separating an image such as character, thin line, or the like in which it is better not to execute the binarization halftone process from image data which is sent from the CRT signal receiver 4. The image separator 6 also includes a processor for executing a simple binarizing process in the case where the binarization halftone process is not performed. An example of method of image separation which is executed in the image separator 6 will now be explained hereinbelow.

Luminance Discrimination Separating Method

A method of separating an image on the basis of a magnitude of a luminance value of the CRT image signal as separating means. Generally, since a character, a thin line, or the like of a computer or the like is data that is important on a picture plane, its luminance is relatively high. Therefore, such a method is a method of discriminating and separating an image of a high luminance from the CRT image signal.

Reference numeral 7 denotes a synthesizer (with a change-over priority) for overlapping the data derived by the pseudo halftone processor 5 and the simple binarization data obtained by the image separator 6. The image data of the portion discriminated by the image separator 6 is preferentially subjected to a simple binarization. The user can switch the execution of such a priority function.

Reference numeral 8 denotes a compressor. When the two-value data which was two-value pseudo halftone processed by the synthesizer 7 is stored into a frame memory 11, the compressor 8 compresses the data of the two-value data in order to reduce a capacity of the frame memory.

Reference numeral 9 denotes an expander for expanding the two-value data of one frame stored in the frame memory 11.

Reference numeral 10 denotes a partial write controller for detecting a portion rewritten by the image data in the frame in the display panel unit (for example, display panel using ferroelectric liquid crystal) 3 having a memory performance and preferentially outputting the data of the rewritten portion to the display panel unit 3. By such a function, the rewritten portion can be preferentially drawn.

Reference numeral 11 denotes the frame memory for storing the image data.

Reference numeral 17 denotes a controller for controlling each portion constructing the display controller 1 and the connection with each of the other portions is omitted.

Reference numeral 12 denotes a CPU for controlling the computer 2; 13 a system memory in which a control program of the CPU 12 has been stored and which is also used as a work area or the like of the CPU 12; 14 a frame memory in which image data of the computer 2 has been stored; 15 a CRT controller for controlling the transmission of the image data stored in the frame memory 14 to the display controller 1; and 16 a CRT interface for converting the image data stored in the frame memory 14 into the data for the CRT signal (including the analog signal and color conversion).

The operation of each circuit in FIG. 1 is now described.

First, the computer 2 as an image data source outputs the image data stored in the frame memory 14 as a CRT signal through the CRT interface 16 on the basis of the control of the CRTC 15. The CRT signal is divided into a video signal (in case of a color display, analog signals of three systems of R, G, and B; in case of a monochromatic display, analog signal of one system) and sync signals (signals to divide the video signal every line or frame; called a horizontal sync signal and a vertical sync signal).

The CRT signal is supplied to the CRT signal receiver 4. The video signal is converted to the digital signal (consisting of a plurality of bits) by the A/D converter. A sampling clock in this instance is formed by increasing the horizontal sync signal an integer times in the PLL circuit. The horizontal and vertical sync signals received in the sync signal receiver are used in the PLL circuit. The operation of the PLL circuit will now be described.

The digitized video signal is supplied to the pseudo halftone processor 5 and is converted to the two-values or multi-values. As a converting procedure in this instance, since the CRT signal that is supplied is sequentially converted, it is converted by a non-interlace manner. The pseudo halftone process can be executed as a principle in the distribution of errors and the calculation of the threshold value. A halftone reproducibility is improved.

The digital signal from the CRT signal receiver 4 is simultaneously inputted to the image separator 6. The signal such as character, thin line, or the like which is not suitable for the pseudo halftone process as mentioned above is discriminated and only such a portion is subjected to a simple two-value or multi-value process and the processed signal is outputted.

The two-value or multi-value signals obtained by the pseudo halftone processor 5 and image separator 6 are properly switched in the synthesizer 7 and outputted to the compressor 8. In such a switching operation, the simple two-value or multi-value signal derived by the image separator 6 is preferentially outputted.

The priority in this instance can be also forcedly switched in the display controller 1 by a request from the user or by an instruction from the computer 2. Such a process is effective in case of preferentially displaying a character or a thin line or in case of preferentially displaying a natural image such as a photograph or the like.

The compressor 8 compresses the signal from the synthesizer 7 and sends to the frame memory 11. As a compressing method, it is preferable to use a compressing method of a line unit because the partial write control is executed on a line unit basis.

The compressed signal from the compressor 8 is also supplied to the partial write controller 10. The partial write controller 10 reads out the compressed signal of at least one frame before from the frame memory 11 and compares with the signal sent from the compressor 8. The partial write controller 10 detects the line of the pixel having a difference by both of those signals and controls the frame memory 11 so as to preferentially output the line signal and line data to the expander 9.

The display panel unit 3 receives the line signal from the display controller 1 and draws the image data onto the display panel in accordance with the line data and line signal.

When a drawing speed of the display panel unit 3 is slower than an input transfer speed of the video signal that is inputted, the execution of the two-value or multi-value pseudo halftone process for all of the input video signals results in a vain process because all of the two-value or multi-value signals cannot be drawn. The input video signal is thinned out on a frame unit basis in accordance with the drawing speed of the display panel unit 3 and is inputted. Consequently, the time that is required for executing the two-value or multi-value pseudo halftone process is increased by the time corresponding to the frames which were thinned out, so that the processing operating speed can be reduced.

In the case where the user wants to form the pseudo halftone processor 5 as an IC, therefore, a heat generation or an erroneous operation by the high speed operation can be suppressed.

The PLL circuit in the CRT signal receiver 4 will now be described with reference to FIG. 2.

Figure 2:
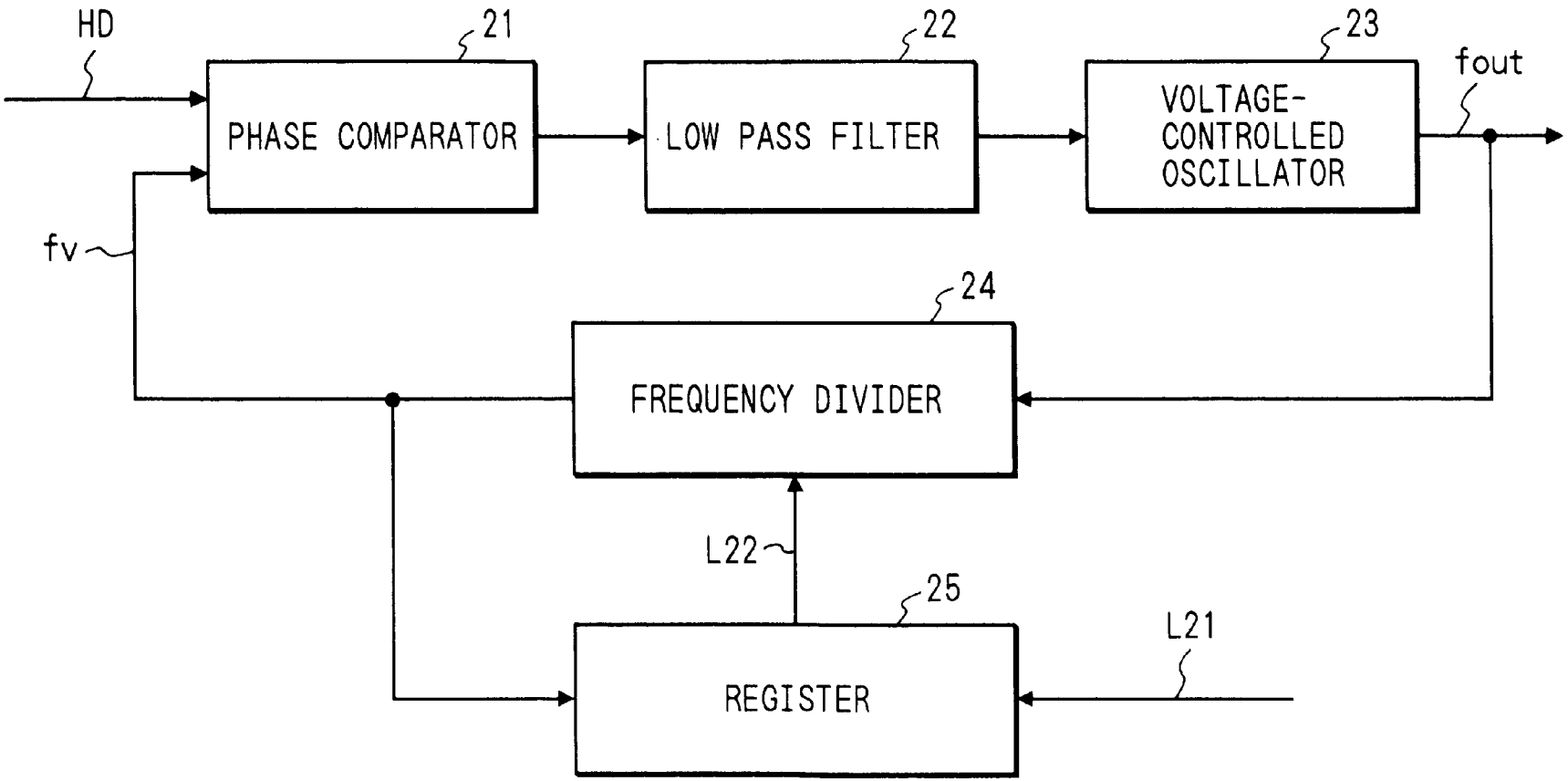
FIG. 2 is a block diagram of a PLL circuit.

FIG. 2 is a block diagram of the PLL circuit.

First, a horizontal sync signal HD serving as a fundamental signal is inputted to one input terminal of a phase comparator 21. A signal fv is supplied to another input terminal of the phase comparator 21. The phase comparator 21 detects a phase difference (advance/lag of the phase) of those two input signals and converts the phase difference into a voltage amount. The phase comparator 21 doesn't continuously compare the phases but compares the phases every period of the horizontal sync signal HD and converts the result into the voltage. Therefore, an output signal of the phase comparator 21 becomes an AC-like signal and is integrated and smoothed by a low pass filter 22 at the next stage, thereby generating a DC-like voltage component that is proportional to the phase difference. The DC-like voltage component is outputted to a voltage controlled oscillator (VCO) 23 at the next stage. The voltage controlled oscillator 23 is an oscillator whose oscillating frequency is controlled by a voltage value of the input signal. An output signal fout of the oscillator becomes a dot clock signal.

The output signal fout is inputted to a frequency divider 24. The frequency divider 24 frequency divides the signal fout on the basis of a frequency division parameter that is set into a frequency division parameter register 25. The feedback signal fv is produced as a frequency division result and is outputted to the phase comparator 21. The feedback signal fv corresponds to a carry signal of the frequency divider 24. A counting up/down operation is performed on the basis of the frequency division parameter and the signal is generated when all "1" or all "0". The feedback signal fv also functions as a latch signal (loading signal) of the frequency division parameter register 25 and corresponds to a successive updating of the frequency division parameter.

From such a PLL operation, the dot clock signal fout serving as an integer-times frequency corresponding to the frequency division parameter is generated while synchronizing by using the horizontal sync signal HD as a reference signal.

Figure 4:
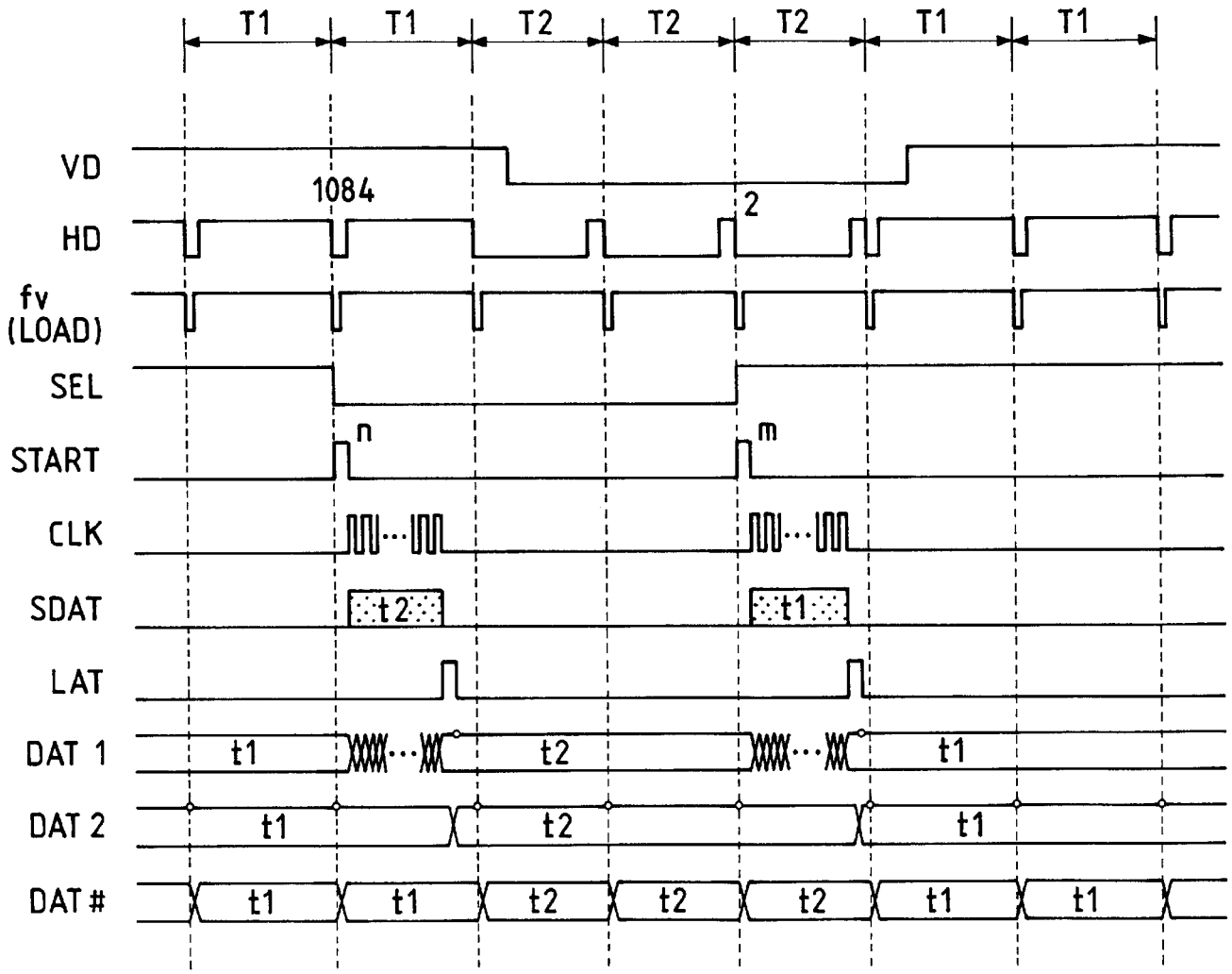
FIG. 4 is a timing chart of an embodiment of the invention.

FIG. 4 shows a timing chart in the embodiment.

In FIG. 4, as a horizontal sync signal HD, two kinds of periods (two frequencies) T1 and T2 exist. The period T2 exists for 3H (means three horizontal sync periods) of a vertical blanking pulse portion (portion at the low level of a vertical sync signal VD). The period T1 exists for an effective display period (portion at the high level of the vertical sync signal VD) excluding the vertical blanking pulse portion of T2.

The input video signal in the embodiment has the following specifications.

Dot clock frequency: 135 MHz

Horizontal sync frequency T1 portion: 78.2155 kHz

Horizontal sync frequency T2 portion: 78.7631 kHz

Vertical sync frequency: 72.0894 kHz

Vertical blank portion of rear portion: 3H

Vertical blank portion of front portion: 55H

Effective display period portion: 1024H (The portions of 3H, 55H, and 1024H become the T1 portion.)

Vertical blanking pulse portion: 3H (T2 portion)

Figure 3:
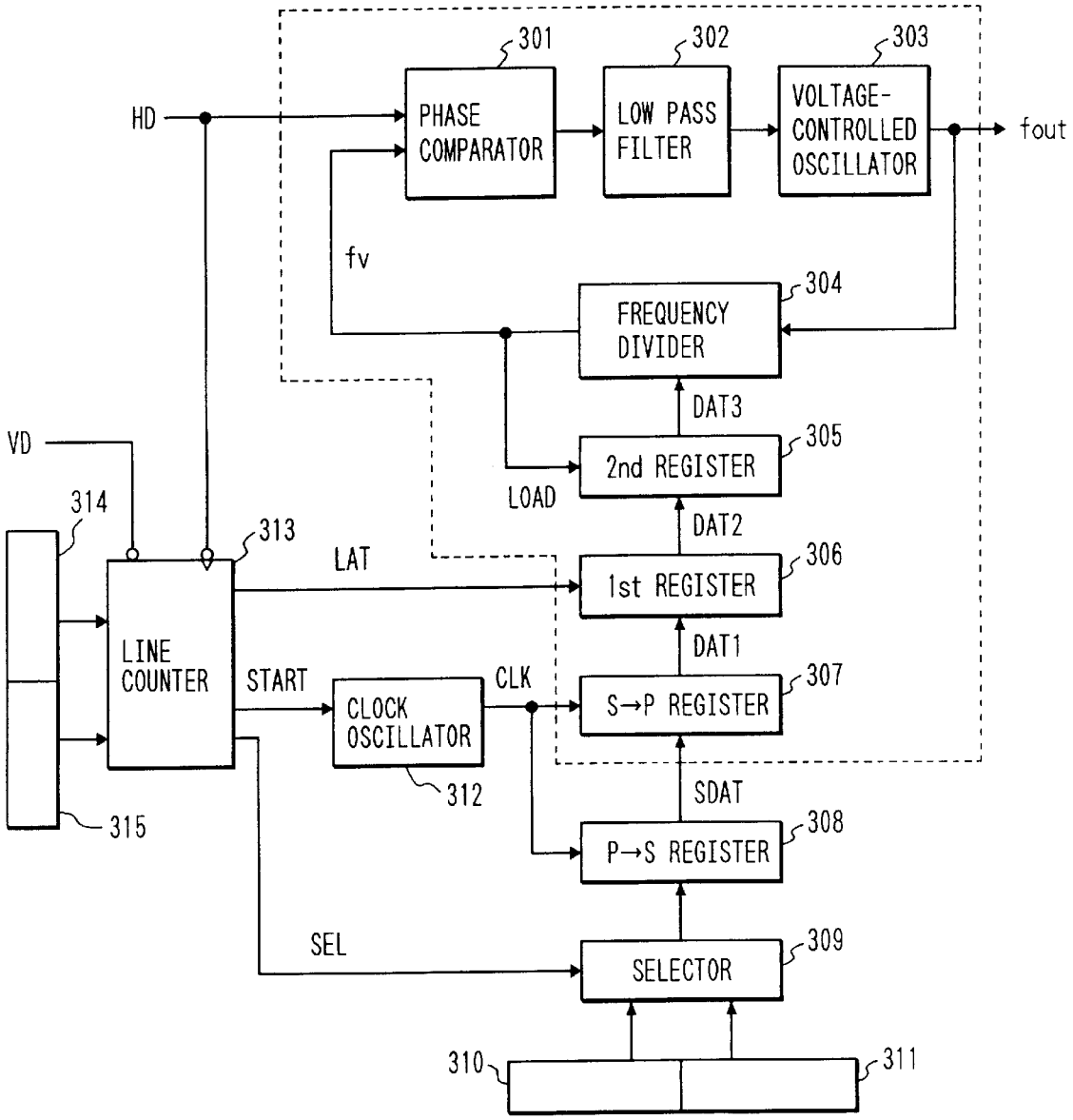
FIG. 3 is a block diagram of an embodiment of the invention.

FIG. 3 shows a construction of the PLL circuit as an embodiment of the invention for the horizontal sync signal HD in which the two horizontal sync frequency T1 and T2 portions as mentioned above exist.

In FIG. 3, the PLL circuit shown in FIG. 2 is constructed by a phase comparator 301, an LPF (low pass filter) 302, a VCO (voltage controlled oscillator) 303, and a frequency divider 304.

A T1 frequency division parameter register 310 stores 20-bit data as a T1 frequency division parameter t1 in the T1 portion. A T2 frequency division parameter register 311 stores 20-bit data as a T2 frequency division parameter t2 in the T2 portion.

Now, t1 and t2 are set as follows.

T1 frequency division parameter t1=1726

T2 frequency division parameter t2=1714

A selector 309 selects either one of the frequency division parameters t1 and t2 on the basis of a selection signal SEL and outputs to a P→S register 308 at the next stage.

The P→S register 308 converts the parallel 20-bit data as a T1 or T2 frequency division parameter (t1 or t2) into a serial 20-bit data signal SDAT synchronously with a transfer clock signal CLK and transfers the signal SDAT to an S→P register 307 at the next stage.

The S→P register 307 fetches the serial 20-bit data SDAT synchronously with the transfer clock signal CLK, converts to the parallel 20-bit data, and outputs as DAT1 to a first register 306 at the next stage.

The reason why the frequency division parameter is once converted from the parallel 20-bit data to the serial 20-bit data and is again converted to the serial data is because the PLL circuit portion shown by a broken line in the embodiment is constructed by one IC and its input is a serial input port.

Therefore, it will be understood that various modifications and variations of the circuit construction shown in FIG. 3 are possible within the purview of the spirit of the present invention.

The first register 306 stores DAT1 by a latch signal LAT and outputs as parallel 20-bit data DAT2 to a second register 305 at the next stage.

The second register 305 latches DAT2 by the feedback signal fv (LOAD) and outputs as a frequency division parameter DAT3 to the frequency divider 304.

The feedback signal fv is a load signal of the frequency division parameter DAT3 to the frequency divider 304.

An L1 line count parameter register 314 sets a line count parameter m of the horizontal sync signal HD to decide a timing for transferring the frequency division parameter t1 into the serial 20-bit data signal SDAT. An L2 line count parameter register 315 sets a line count parameter n of the horizontal sync signal HD to decide a timing for transferring the frequency division parameter t2 into the serial 20-bit data signal SDAT.

In the embodiment, m and n are set as follows.

L1 line count parameter m=2

(t1 transfer start line number)

L2 line count parameter n=1082+m=1084

(t2 transfer start line number;

1082=vertical blank period 55H of the front portion+effective display period 1024H+vertical blank period 3H of the rear portion)

A line counter 313 counts the horizontal sync signal HD by using the vertical sync signal VD as a reference of the counting operation, thereby producing the selection signal SEL, a transfer start signal START, and the latch signal LAT at the timings corresponding to the line count parameters m and n.

A clock oscillator 312 generates the clock CLK of a predetermined frequency for a predetermined time on the basis of the transfer start signal START.

The operation of FIG. 3 will now be described with reference to FIG. 4.

The line counter 313 detects a trailing edge of the vertical sync signal VD and starts the counting operation on the basis of the line count parameters m and n. Since m=2, the transfer start signal START is generated at the second count of the horizontal sync signal HD from the start of the counting operation. The transfer operation of the frequency division parameter t1 of the T1 portion is executed. Simultaneously with the generation of the start signal START, the serial data SDAT is transferred synchronously with the transfer clock CLK and the frequency division parameter t1 is stored into the first register 306 by the latch signal LAT. The transfer operation is completed within 1H. The frequency division parameter t1 stored in the first register 306 is outputted as DAT2 and is stored into the second register 305 by the pulse portion of the feedback signal fv. At the same time, the updated frequency division parameter is outputted to the frequency divider 304 as DAT3. The frequency divider 304 executes the counting operation on the basis of the frequency division parameter t1. After completion of the counting operations of 1726 times (=frequency division pulse parameter t1) corresponding to the T1 period, the feedback signal fv that is equivalent to the carry signal of the frequency divider 304 is produced and generated. The frequency division parameter t1 is loaded and, at the same time, the counting operation is again executed.

The above operations are repeated after the elapse of one vertical sync period in which the T1 portion continues, thereby performing the PLL operation.

Subsequently, the line counter 313 judges the switching portion (namely, the 1084th signal when counting the horizontal sync signal HD from the trailing edge of the vertical sync pulse) between the T1 and T2 portions on the basis of n=1084 set in the L2 line count parameter register 315 and again generates the transfer start signal START.

Subsequently, the frequency division parameter t2 corresponding to the T2 period portion is changed and set in a manner similar to the foregoing frequency division parameter t1, thereby executing the PLL operation.

By repeating the above operations, the dot clocks are reproduced.

According to the present invention as described above, even if a plurality of frequencies mixedly exist in a reference frequency, the PLL circuit can be certainly operated.

By counting the horizontal sync signal, the PLL circuit can be further certainly operated as compared with the case of switching by the vertical sync signal.

Since the vertical sync signal is used as a reference, the PLL circuit can be certainly operated by a simple counter construction.

When a plurality of frequencies exist in the horizontal sync signal, the dot clocks can be stably reproduced. An image can be stably displayed by the reproduced dot clocks.

According to the invention as described above, when the PLL circuit is operated, even if a plurality of frequencies exist in the reference signal, by providing the frequency division parameter corresponding to each frequency, an increase in jitter and an unlocking state which become problems in the PLL circuit can be avoided. The system can be operated in a stable state.

What is claimed is:

1. A display control apparatus for forming a dot clock signal for display corresponding to a video signal from a first sync signal and executing a display control, the first sync signal having frequencies alternating between a first frequency and a second frequency, said apparatus comprising:

comparing means for comparing the first sync signal and a frequency division signal;

clock forming means for forming the dot clock signal for display on the basis of a comparison made by said comparing means;

storing means for storing a frequency division parameter of the dot clock signal for display;

frequency division signal forming means for forming the frequency division signal from the frequency division parameter stored in said storing means and the dot clock signal for display formed by said clock forming means;

counting means for counting the first sync signal; and changing means for changing the frequency division parameter stored in said storing means to a first division value when a count value of said counting means reaches a first value, and changing the frequency division parameter stored in said storing means to a second division value when the count value of said counting means reaches a second value.

2. An apparatus according to claim 1, wherein the first sync signal comprises a horizontal sync signal.

3. An apparatus according to claim 1, wherein said counting means counts said first sync signal by using a second sync signal as a reference.

4. An apparatus according to claim 3, wherein the first sync signal comprises a horizontal sync signal.

5. An apparatus according to claim 3, wherein the second sync signal comprises a vertical sync signal.

6. An apparatus according to claim 1, further comprising clearing means for clearing the count value of said counting means.

7. An apparatus according to claim 6, wherein said clearing means clears the count value of said counting means on the basis of the second sync signal.

8. An apparatus according to claim 6, wherein the second sync signal comprises a vertical sync signal.

9. A display control apparatus comprising:

comparing means for comparing a first sync signal and a frequency division signal, the first sync signal having frequencies alternating between a first frequency and a second frequency;

clock forming means for forming a dot clock signal for display on the basis of a comparison made by said comparing means;

storing means for storing a frequency division parameters of the dot clock signal for display;

frequency division signal forming means for forming the frequency division signal from the frequency division parameters stored in said storing means and the dot clock signal for display formed by said clock forming means;

counting means for counting the first sync signal;

changing means for changing the frequency division parameter stored in said storing means to a first division value when a count value of said counting means reaches a first value, and changing the frequency division parameter stored in said storing means to a second division value when a count value of said counting means reaches a second value;

a converter for analog-digital converting an image signal that is supplied from an outside source on the basis of the dot clock signal, thereby forming display data;

data storing means for storing the display data converted by said converter; and a display for displaying the display data stored in said data storing means.

10. An apparatus according to claim 9, wherein the first sync signal comprises a horizontal sync signal.

11. An apparatus according to claim 9, wherein said display comprises a ferroelectric liquid crystal display.

12. An apparatus according to claim 9, further comprising a data supplier for supplying the image signal.

13. A display control method for forming a dot clock signal for display corresponding to a video signal from a first sync signal and executing a display control, the first sync signal having frequencies alternating between a first frequency and a second frequency, said method comprising the steps of:

comparing the first sync signal and a frequency division signal;

forming the dot clock signal for display on the basis of a comparison in said comparing step;

storing a frequency division parameter of the dot clock signal for display in storing means;

forming the frequency division signal from the frequency division parameter stored in the storing means and the dot clock signal for display formed in said dot clock forming step;

counting the first sync signal; and changing the frequency division parameter stored in the storing means to a first division value when a count value in said counting step reaches a first value, and changing the frequency division parameter stored in the storing means to a second division value when the count value in said counting step reaches a second value.

14. A method according to claim 13, wherein said counting step includes counting the first sync signal by using a second sync signal as a reference.

15. A method according to claim 13, wherein the first sync signal comprises a horizontal sync signal.

16. A method according to claim 14, wherein the first sync signal comprises a horizontal sync signal.

17. A method according to claim 14, wherein the second sync signal comprises a vertical sync signal.

18. A display control method comprising the steps of:

comparing a first sync signal and a frequency division signal, the first sync signal having frequencies alternating between a first frequency and a second frequency;

forming a dot clock signal for display on the basis of a comparison in said comparing step;

storing a frequency division parameter of the dot clock signal for display in storing means;

forming the frequency division signal from the frequency division parameter stored in the storing means and the dot clock signal for display formed in said dot clock forming step;

counting the first sync signal; and changing the frequency division parameters stored in the storing means to a first division value when a count value in said counting step reaches a first value, and changing the frequency division parameter stored in the storing means to a second division value when the count value in said counting step reaches a second value;

analog-digital converting an image signal supplied from an outside source on the basis of the dot clock signal, thereby forming display data;

storing the display data converted in said converting step; and displaying the display data stored in said data storing step on display means.

19. A method according to claim 18, wherein the first sync signal comprises a horizontal sync signal.

20. A method according to claim 18, wherein said display means comprises a ferroelectric liquid crystal display.

21. A method according to claim 18, further comprising the step of supplying the image signal from a data supplier.

* * * * *

UNITED STATES PATENT AND TRADEMARK OFFICE

CERTIFICATE OF CORRECTION

PATENT NO. : 5,945,983

DATED : August 31, 1999

INVENTOR(S): HIDEO KANNO, ET AL.

It is certified that error appears in the above-identified patent and that said Letters Patent is hereby corrected as shown below:

COLUMN 9:

Line 11, "parameters" should read --parameter--.
Line 15, "parameters" should read --parameter--.

COLUMN 10:

Line 35, "parameters" should read --parameter--.

Signed and Sealed this

Eighteenth Day of July, 2000

*Attest:*

Q. TODD DICKINSON

*Attesting Officer*

*Director of Patents and Trademarks*